US009835322B1

(12) United States Patent
Lovicott

(10) Patent No.: US 9,835,322 B1
(45) Date of Patent: Dec. 5, 2017

(54) FLOW THROUGH EXTENDED SURFACE TROFFER SYSTEM

(71) Applicant: Universal Lighting Technologies, Inc., Madison, AL (US)

(72) Inventor: Dominick Lovicott, Madison, AL (US)

(73) Assignee: UNIVERSAL LIGHTING TECHNOLOGIES, INC., Madison, AL (US)

( * ) Notice: Subject to any disclaimer, the term of this patent is extended or adjusted under 35 U.S.C. 154(b) by 431 days.

(21) Appl. No.: 14/682,811

(22) Filed: Apr. 9, 2015

(51) Int. Cl.

| | |
|---|---|
| ***F21V 29/00*** | (2015.01) |
| ***F21V 29/83*** | (2015.01) |
| ***F21V 29/15*** | (2015.01) |
| ***F21V 23/00*** | (2015.01) |
| ***F21V 7/00*** | (2006.01) |
| *F21Y 101/02* | (2006.01) |

(52) U.S. Cl.
CPC ..... *F21V 29/83* (2015.01); *F21V 7/0083* (2013.01); *F21V 23/005* (2013.01); *F21V 29/15* (2015.01); *F21Y 2101/02* (2013.01)

(58) Field of Classification Search
CPC ..... F21V 29/83; F21V 7/0083; F21V 29/15; F21V 23/005
USPC ..... 362/218, 294, 373
See application file for complete search history.

(56) References Cited

U.S. PATENT DOCUMENTS

| | | | | |
|---|---|---|---|---|
| 3,348,465 | A | 10/1967 | Kruger | |
| 5,313,375 | A | 5/1994 | Jones | |
| 2009/0290348 | A1* | 11/2009 | Van Laanen | F21V 3/02 362/249.02 |
| 2014/0293624 | A1* | 10/2014 | He | F21V 29/004 362/373 |
| 2015/0043208 | A1* | 2/2015 | Engelhardt | F21V 3/04 362/241 |

* cited by examiner

*Primary Examiner* — Sean Gramling
*Assistant Examiner* — Gerald J Sufleta, II
(74) *Attorney, Agent, or Firm* — Patterson Intellectual Property Law, P.C.; Mark J. Patterson; Gary L. Montle

(57) ABSTRACT

A lighting apparatus includes a printed circuit board. A first light source and a second light source can be mounted on the printed circuit board. A first optical member can receive and redirect light from the first light source, and a second optical member can receive and redirect light from the second light source. A vent aperture can be defined in the printed circuit board, the vent aperture being positioned between the optical members. The apparatus can include first and second thermally conductive sheets thermally coupled to the printed circuit board, the first thermally conductive sheet disposed on a first back side of the first optical member, the second thermally conductive sheet disposed on a second back side of the second optical member. The apparatus can include a housing having a housing vent, the housing vent and the vent aperture defining a first convective path between the optical members.

13 Claims, 7 Drawing Sheets

FLOW THROUGH EXTENDED SURFACE TROFFER SYSTEM

A portion of the invention of this patent document contains material that is subject to copyright protection. The copyright owner has no objection to the reproduction of the patent document or the patent invention, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to lighting systems. There are a variety of lighting systems and particularly troffer lighting systems which can be used to illuminate open spaces. Light emitting diodes (LEDs) are becoming increasingly popular as a lighting source because they are energy efficient, durable, and long-lasting. However, light sources, including LEDs, tend to generate a substantial amount of heat as they are being operated. If heat produced by the light source is not dissipated from the lighting system, then the lighting system can become increasingly hot, which can have negative effects for the overall functionality and efficiency of the lighting system, and can be potentially hazardous to the end user.

More particularly, this invention pertains to a lighting system with improved heat dissipation. In some conventional solutions, a printed circuit board for one or more light sources can be directly attached to a light fixture troffer or housing in an effort to increase conduction, convection, and radiation between the light source and the surroundings. Direct attachment of the printed circuit board to the troffer or housing limits the design to direct lighting systems. Such lighting systems can be undesirable as they can produce glare and shadows to observers.

In other embodiments, heat sinks have been used to dissipate heat away from light sources. The printed circuit board can be attached directly to a heat sink. Heat sinks, while effective, can add to the cost of the overall lighting system. Additionally, in indirect lighting systems, heat sinks are necessarily directly seen by an observer, and may not be aesthetically pleasing when incorporated into such lighting systems.

What is needed, then, are improvements to lighting systems with heat dissipation systems.

BRIEF SUMMARY OF THE INVENTION

One aspect of the present invention is a lighting apparatus including a printed circuit board having a first side and a second side. A first light source can be mounted on the first side of the printed circuit board and a second light source can be mounted on the second side of the printed circuit board. A first optical member can be positioned to receive and redirect light from the first light source. A second optical member can be positioned to receive and redirect light from the second light source. At least one vent aperture can be defined in the printed circuit board, the vent aperture located between the first and second optical members. The vent aperture in the printed circuit board can help allow air to pass between the two optical members.

In some embodiments, the lighting apparatus may additionally include a housing at least partially surrounding the printed circuit board, the first and second light sources, and the first and second optical members. The housing can include a housing vent. The housing vent and the aperture in the printed circuit board define a first convective path between the first and second optical members. The first convective path can help increase convection between the printed circuit board and the ambient as well as between the first and second optical members and the ambient.

In another aspect, the present invention is a lighting apparatus including a printed circuit board and a first light source mounted on the printed circuit board. A first optical member can be positioned to receive and redirect light projected from the first light source, the first optical member having a first back side facing away from the first light source. The apparatus can include a first thermally conductive sheet thermally coupled to the printed circuit board and extending over the first back side of the first optical member. As such, the thermally conductive sheet can act as an extended heat transfer surface that can help increase heat dissipation away from the printed circuit board and the first light source via increased conduction, convection, and radiation from the thermally conductive sheet.

Yet another aspect of the present invention is a lighting apparatus including a printed circuit board. A first light source and a second light source can be mounted to the printed circuit board. A first optical member can be positioned to receive and redirect light from the first light source, the first optical member having a first back side facing away from the first light source. A second optical member can be positioned to receive and redirect light from the second light source, the second optical member having a second back side facing away from the second light source. A first thermally conductive sheet can be thermally coupled to the printed circuit board and disposed on the first back side of the first optical member. A second thermally conductive sheet can be thermally coupled to the printed circuit board and disposed on the second back side of the second optical member. A vent aperture can be defined in the printed circuit board between the first and second thermally conductive sheets. As such, the thermally conductive sheets can help increase heat dissipation away from the printed circuit board. Additionally, the vent aperture can allow air to circulate between the thermally conductive sheets, thereby helping increase convection between the thermally conductive sheets and the ambient.

Numerous other objects, advantages and features of the present invention will be readily apparent to those of skill in the art upon a review of the following drawings and description of a preferred embodiment.

DETAILED DESCRIPTION OF THE INVENTION

Figure 1:
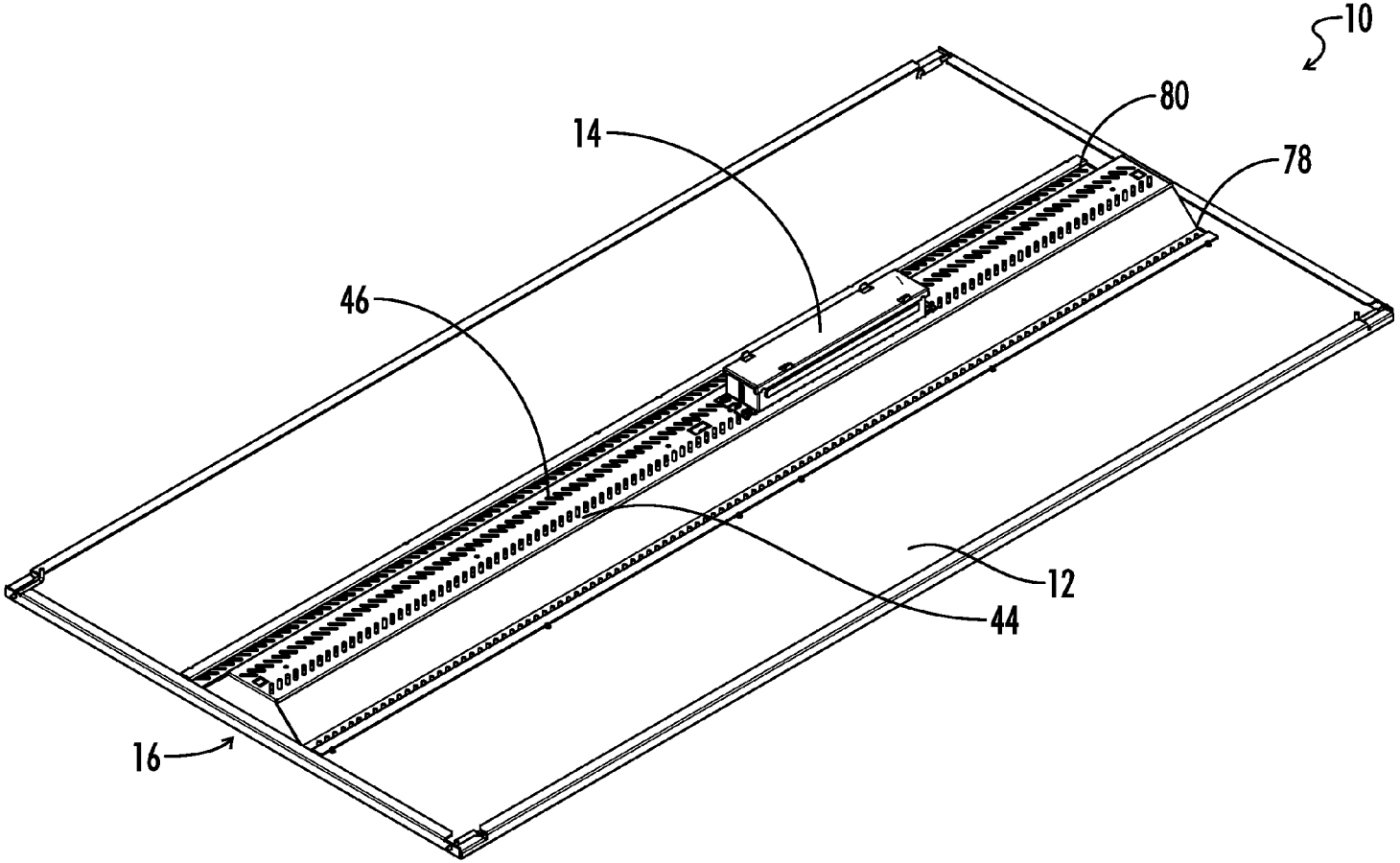
FIG. 1 is a top perspective view of an embodiment of a lighting apparatus of the present invention

While the making and using of various embodiments of the present invention are discussed in detail below, it should be appreciated that the present invention provides many applicable inventive concepts that is embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The term "lateral" denotes a side to side direction when facing the "front" of an object.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the apparatuses and/or methods disclosed and claimed herein may be made and/or executed without undue experimentation in light of the present invention. While the apparatuses and methods of this invention have been described in terms of the embodiments included herein, it will be apparent to those of ordinary skill in the art that variations may be applied to the apparatuses and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

A top perspective view of an embodiment of a lighting apparatus 10 of the present invention is shown in FIG. 1. The lighting apparatus 10 can include a housing 12 and a light source driver 14 connected to the housing 12. The housing 12 can contain a recess that can receive the various components of the lighting apparatus 10. The light source driver 14 can provide power to the apparatus 10 during use.

Figure 2:
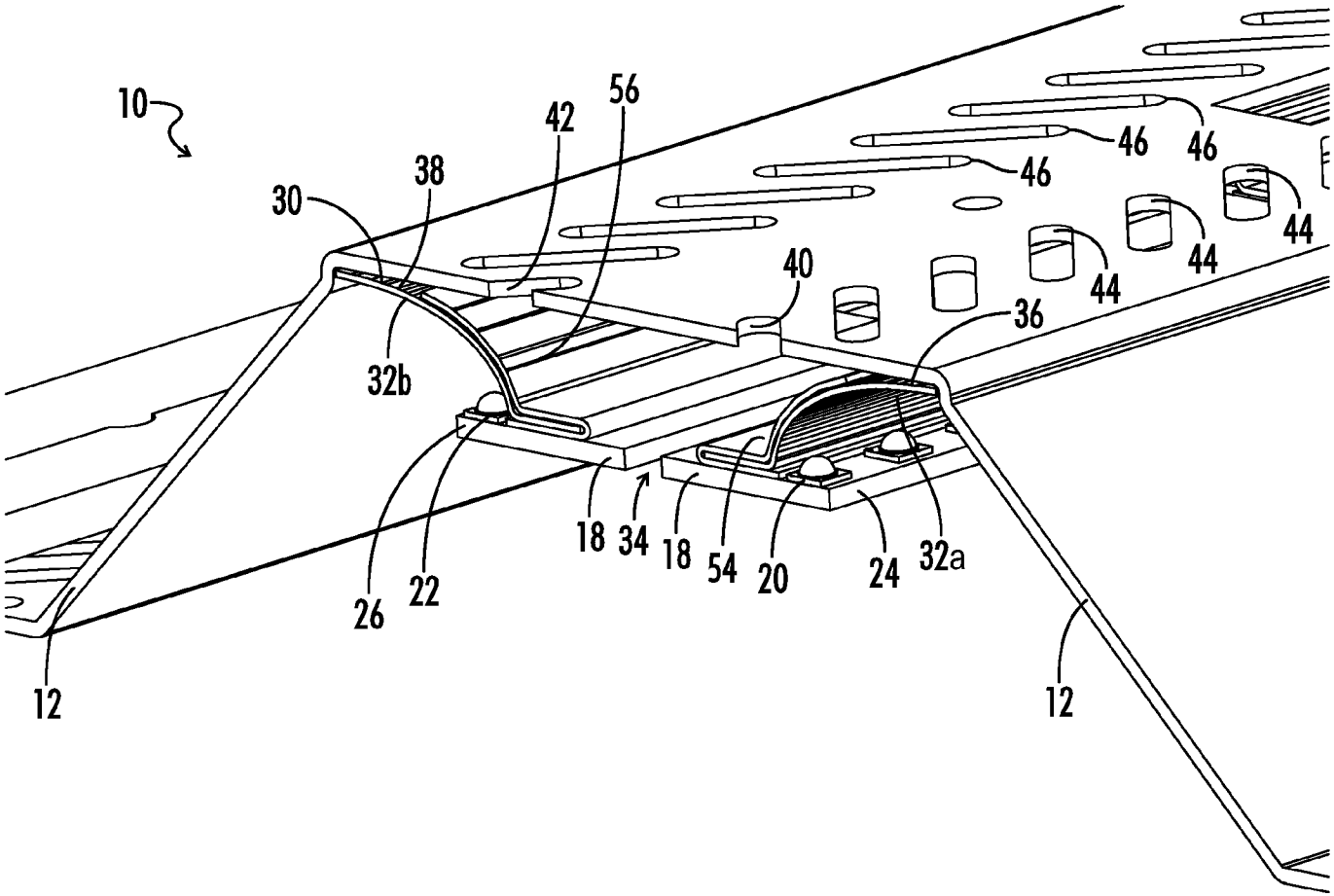
FIG. 2 is a perspective partial cross-sectional view of the lighting apparatus of FIG. 1.

A perspective partial cross-sectional view of the lighting apparatus 10 of FIG. 1 is shown in FIG. 2. The apparatus 10 can include a printed circuit board 18. A first light source 20 and a second light source 22 can be mounted to the printed circuit board 18. In some embodiments, the printed circuit board 18 can have a first side 24 and a second side 26. The first light source 20 can be mounted to the first side 24 of the printed circuit board 18. The second light source 22 can be mounted to the second side 26 of the printed circuit board 18. The light source driver 14 shown in FIG. 1 can be electrically connected to the printed circuit board 18 such that power can be supplied to the light sources 20 and 22 from the light source driver 14 via the printed circuit board 18.

A first optical member 28 can be positioned to receive and redirect light from the first light source 20, and a second optical member 30 can be positioned to receive and redirect light from the second light source 22. In some embodiments, the first and second optical members 28 and 30 can have reflective surfaces 32*a* and 32*b*. In some embodiments, reflective surfaces 32*a* and 32*b* can be specular reflective surfaces. In other embodiments, reflective surfaces 32*a* and 32*b* can be total internal reflective surfaces. The reflective surfaces 32*a* and 32*b* can redirect light from the light sources 20 and 22 in a downward direction in FIG. 2 out of the lighting apparatus 10.

In some embodiments, the lighting apparatus 10 can include at least one vent aperture 34 extending through the printed circuit board 18. The vent aperture 34 can be positioned or located on the printed circuit board 18 between the first and second optical members 28 and 30 such that air can pass through the vent aperture 34 and between the optical members 28 and 30. The vent aperture 34 being located between the first and second optical members 28 and 30 is defined as the vent aperture 34 being located at a horizontal or vertical position that is between the horizontal or vertical positions of the first and second optical members 28 and 30 respectively. Thus, the aperture can be positioned slightly below, above, to the left, or to the right of the optical members 28 and 30, as shown in FIG. 2, and still be located between the optical members 28 and 30, such that air can pass through the aperture 34 and between the optical members 28 and 30.

In some embodiments, the housing 12 can at least partially surround the printed circuit board 18, the first and second light sources 20 and 22, and the first and second optical members 28 and 30. The housing 12 can include at least one housing vent 40. In some embodiments, a first housing vent 40 can be located or positioned adjacent or proximate to the first optical member 28, and a second housing vent 42 can be located or positioned adjacent or proximate to the second optical member 30. In some embodiments, a first row of housing vents 44 can be located adjacent the first optical member 28, and a second row of housing vents 46 can be located adjacent the second optical member 30.

Figure 3:
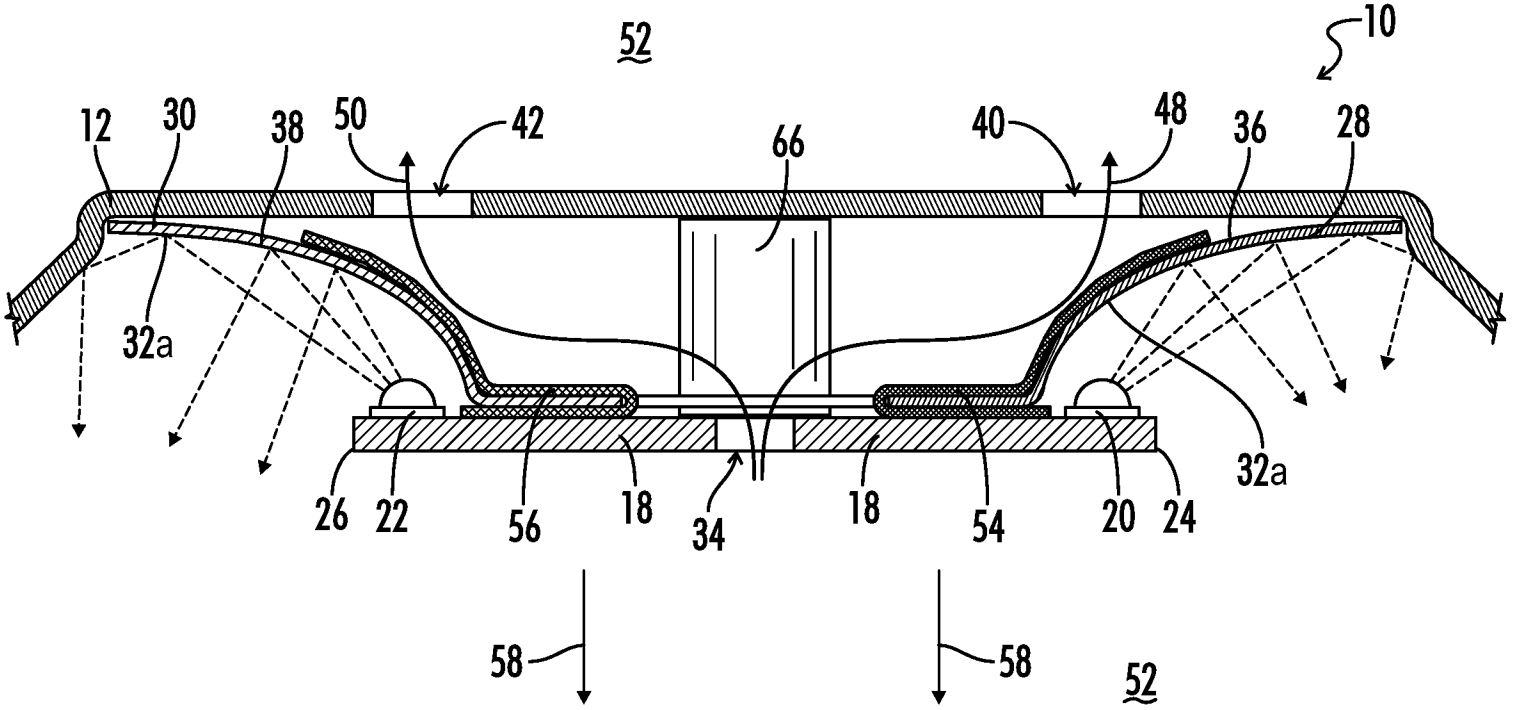
FIG. 3 is a detailed cross sectional view of the lighting apparatus of FIG. 1

Referring now to FIG. 3, the at least one housing vent 40 and the vent aperture 34 in the printed circuit board 18 can define a convective path 48 through the apparatus 10 between the first and second optical members 28 and 30. In those embodiments with a first and second housing vent 40 and 42 positioned adjacent the first and second optical members 28 and 30 respectively, the vent aperture 34 and the first housing vent 40 can define a first convective path 48. The vent aperture 34 and the second housing vent 42 define a second convective path 50. The first convective path 48 can then be positioned adjacent the first optical member 28 and the second convective path 50 can then be positioned adjacent the second optical member 30. Therefore, during use, air can pass through the aperture 34 in the printed circuit board 18 and adjacent to both the first and second optical members 28 and 30, which can help increase convection between the printed circuit board 18 and an exterior 52 of the apparatus 10, and between the first and second optical members 28 and 30 and an exterior 52 of the apparatus 10.

In some embodiments, the vent aperture 34 can be located centrally on the printed circuit board 18, such that the aperture 34 can be substantially equidistant from the first and second optical members 28 and 30. Such positioning of the vent aperture 34 can help equally distribute air to both sides of the lighting apparatus 10.

Referring again to FIG. 2, in some embodiments, the first optical member 28 can have a first back side 36, and the second optical member 30 can have a second back side 38. The first back side 36 can face away from the first light source 20 and be positioned generally opposite the reflective surface 32*a* on the first optical member 28. The second back side 38 can face away from the second light source 22 and be positioned generally opposite the reflective surface 32*b* on the second optical member 30.

The apparatus 10 can include a first thermally conductive sheet 54 disposed on the first back side 36 of the first optical member 28. A second thermally conductive sheet 56 can be disposed on the second back side 38 of the second optical member 30. The first and second thermally conductive sheets 54 and 56 can be thermally coupled to the printed circuit board 18 and extend over or across the first and second back sides 36 and 38 respectively of the first and second optical members 28 and 30. In some embodiments, the first and second thermally conductive sheets 54 and 56 can additionally be thermally coupled to the first and second light sources 20 and 22 respectively.

As the apparatus 10 is being used, the first and second light sources 20 and 22 can produce a substantial amount of heat. Because the light sources 20 and 22 are mounted to the printed circuit board 18, heat from the light sources 20 and 22 can be dissipated to the printed circuit board 18. The first and second thermally conductive sheets 54 and 56 can then be thermally coupled to the printed circuit board 18 to dissipate heat away from the light sources 20 and 22 via the printed circuit board 18.

The thermally conductive sheets 54 and 56 can be formed of any suitable material that can be configured to act as a passive heat exchanger. These materials can include, but are not limited to, aluminum alloys such as 1050A, 6061, or 6063, copper, diamond, or composite materials such as copper tungsten pseudoalloy, silicon carbide in aluminum matrix (AlSiC), diamond in copper-silver alloy matrix (Dymalloy), beryllium oxide in beryllium matrix, or any other suitable materials known in the art. In some embodiments, the first and second thermally conductive sheets 54 and 56 are made from graphite. In some embodiments, the thermally conductive sheets 54 and 56 can have a thermal conductivity greater than about 100 W/mK. In other embodiments, the thermally conductive sheets 54 and 56 can have a thermal conductivity greater than about 200 W/mK. A higher thermal conductivity can help increase the amount of heat that is dissipated away from the printed circuit board 18 and the light sources 20 and 22 through conduction with the thermally conductive sheets 54 and 56.

The first and second thermally conductive sheets 54 and 56 extend across the first and second back sides 36 and 38 of the first and second optical members 28 and 30 respectively to provide extended thermally conductive surfaces which can also help increase dissipation of heat from the light sources 20 and 22 through convection and radiation to the exterior or ambient 52 of the apparatus 10.

Referring again to FIG. 3, in those embodiments including thermally conductive sheets 54 and 56, the vent aperture 34 can additionally be located between the first and second thermally conductive sheets 54 and 56. As such, the first convective path 48 can be defined through the aperture 34 in the printed circuit board 18 and the first housing vent 40 such that air can flow over the first thermally conductive sheet 54. Similarly, the second convective path 50 can be defined through the vent aperture 34 and the second housing vent 42 such that air can flow across the second thermally conductive sheet 56. During operation of the lighting apparatus 10, heat from the light sources 20 and 22 being dissipated to the thermally conductive sheets 54 and 56 can cause the thermally conductive sheets to become hot. Thus, the air immediately around the thermally conductive sheets 54 and 56 can heat up due to convection from the thermally conductive sheets to the air. The warmer air can have relatively lower air pressure. The warm, low pressure air can help encourage air flow along the first and second convective paths 48 and 50 across the thermally conductive sheets 54 and 56, as cooler, high pressure air can move into the space occupied by the warmer air, thereby producing air flow.

Thus the thermally conductive sheets 54 and 56 can help increase conduction of heat away from the printed circuit board 18 and the light sources 20 and 22, and can also help increase air flow over the thermally conductive sheets 54 and 56. Increased air flow can help increase convection from the thermally conductive sheets 54 and 56 to the ambient or exterior 52 of the apparatus 10. An increase in heat dissipation from the lighting apparatus 10 to the ambient or exterior 52 of the apparatus 10 can help lower the overall temperature of the lighting apparatus 10, which can help increase the efficiency and longevity of the apparatus 10, and can also help reduce the potential for fire hazards.

As can be seen from FIG. 3, the lighting apparatus 10 can emit light in a primary emission direction 58. In some embodiments, light sources 20 and 22 can be configured to project light initially in a direction opposite the primary emission direction 58 such that the light is then reflected by the first and second optical members 28 and 30 in the primary emission direction. Additionally, some light can be reflected by the first or second optical members 28 and 30, and subsequently reflect by the housing 12, and emitted in the primary emission direction 58. As such, the lighting apparatus 10 can be an indirect lighting system.

The printed circuit board 18 in some embodiments can be positioned to at least partially obstruct a direct view of the light sources 20 and 22 from the primary emission direction 58. As such, the printed circuit board 18 can help reduce glare to an observer of the apparatus 10. Glare from a lighting apparatus can hurt an observer's eyes and can be undesirable. In some embodiments, the printed circuit board 18, in combination with the housing 12, can obstruct a direct view of the light sources 20 and 22 when the lighting apparatus 20 is viewed from any angle.

Figure 6:
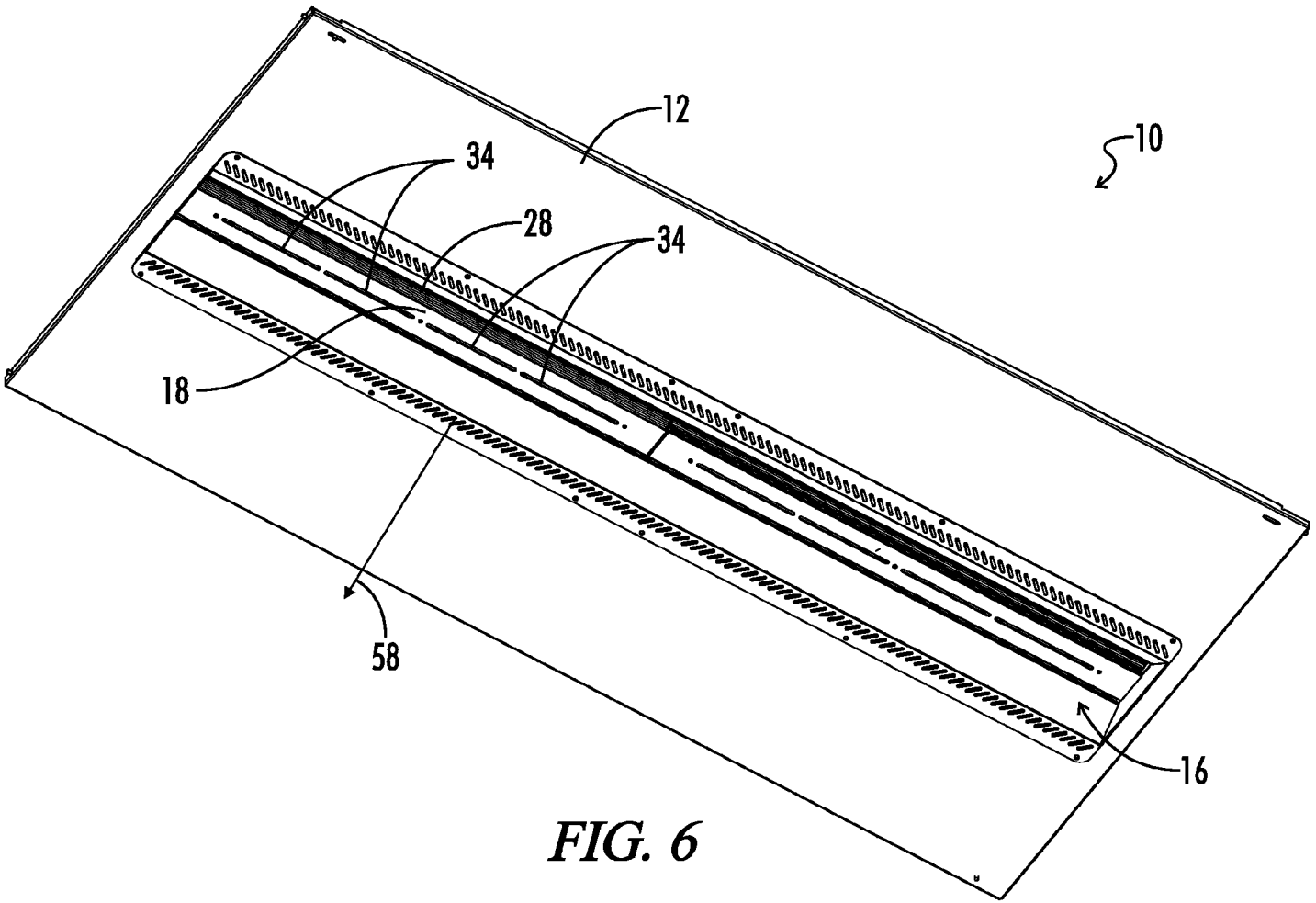
FIG. 6 is a bottom perspective view of the lighting apparatus of FIG. 1.

In some embodiments, the printed circuit board 18 can be positioned to at least partially obstruct a direct view of the thermally conductive sheets 54 and 56 when the apparatus 10 is viewed from the primary emission direction 58. One problem with many conventional indirect lighting systems is that a heat sink must be attached directly to a printed circuit board. Because the lighting system is indirect, a heat sink would typically face or be viewable by an observer. The heat sink may not be aesthetically pleasing to an observer. In the apparatus shown in FIG. 3, the thermal management system is predominantly hidden from the observer, which can help produce a more aesthetically pleasing appearance to the observer, as shown in FIG. 6.

Figure 4:
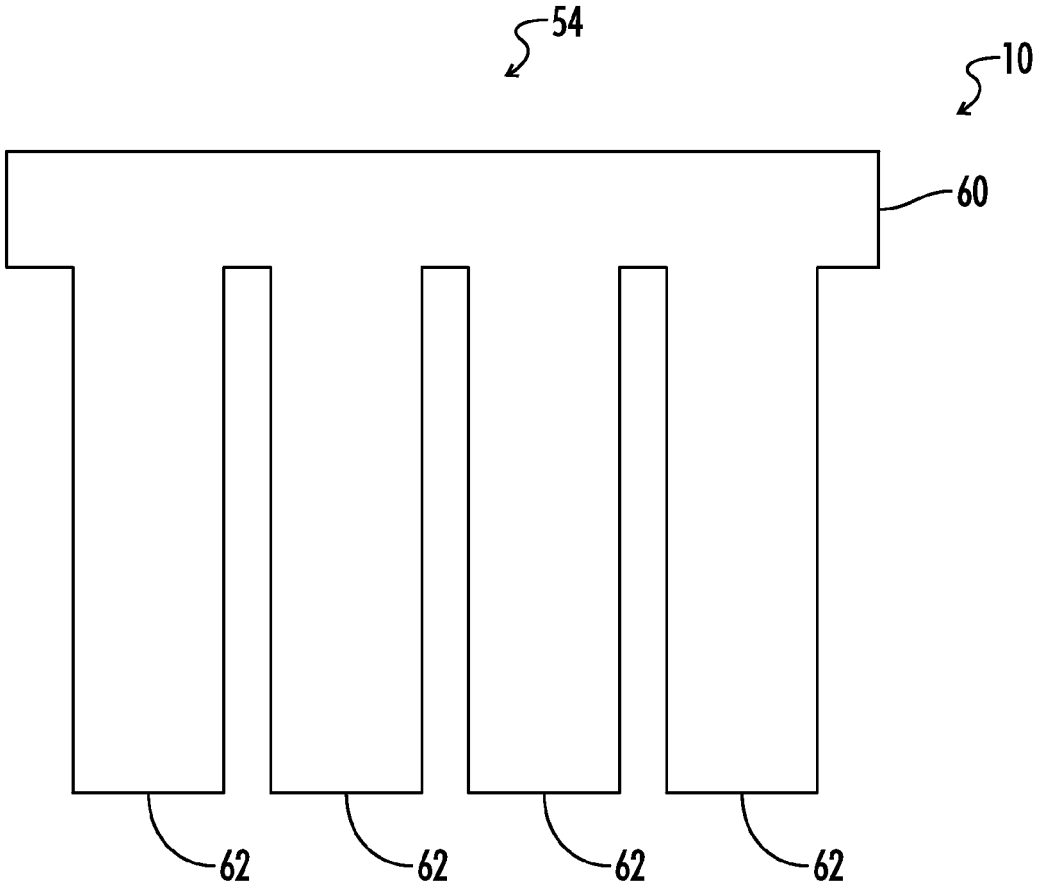
FIG. 4 is a plan view of an embodiment of a thermally conductive sheet of the lighting apparatus of FIG. 1.

A flat plan view of a thermally conductive sheet 54 used in the lighting apparatus of FIG. 1 is shown in FIG. 4. The thermally conductive sheet 54 can include a longitudinal portion 60. The thermally conductive sheet 54 can also include a plurality of strips 62 extending from the longitudinal portion 60. The thermally conductive sheet 54 in some embodiments can be made from a flexible material such that the strips 62 can be bent as needed and adhered to an optical member.

Figure 5:
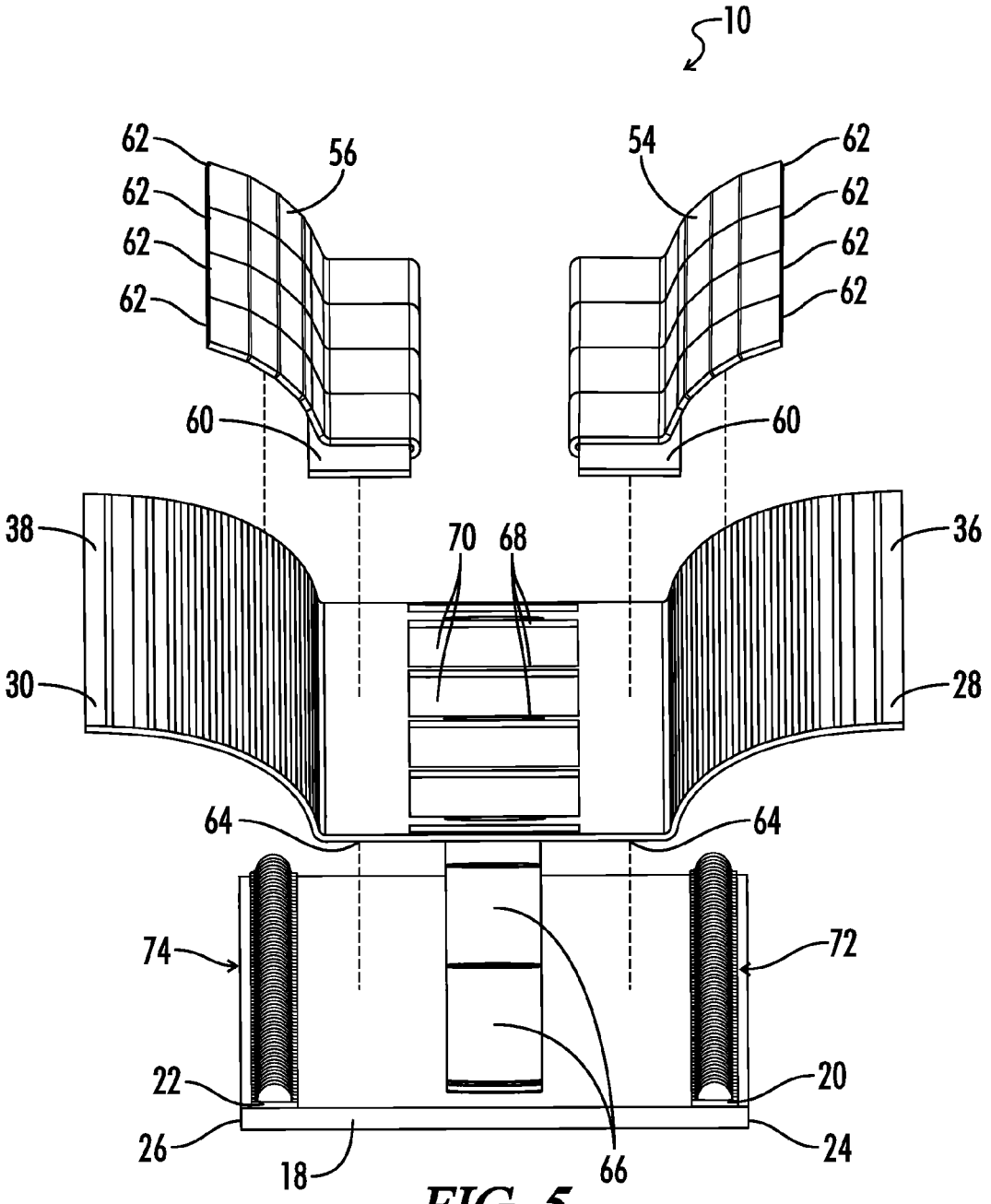
FIG. 5 is a partial exploded view of the lighting apparatus of FIG. 1.

A partial exploded view of the lighting apparatus 10 of FIG. 1 is shown in FIG. 5. The longitudinal portions 60 of the first and second thermally conductive sheets 54 and 56 can be mated or adhered to the printed circuit board 18. Bottom sides 64 of the first and second optical members 28 and 30 can then be placed on top of the longitudinal portions 60 of the first and second thermally conductive sheets 54 and 56 respectively. The plurality of strips 62 on each of the first and second thermally conductive sheets 54 and 56 can be wrapped around the bottom sides 64 of the first and second optical members 28 and 30 respectively. The plurality of strips 62 on each of the first and second thermally conductive sheets 54 and 56 can then be disposed or adhered to the first and second back sides 36 and 38 of the first and second optical members 28 and 30 respectively. Connection rods 66 can then be used to connect the printed circuit board 18 to the housing, as shown in FIG. 3, thereby fixing the optical members 28 and 30 and the thermally conductive sheets 54 and 56 in position on the apparatus 10.

The first and second optical members 28 and 30 in some embodiments can be two separate pieces. In other embodiments, as shown in FIG. 5, the first and second optical members 28 and 30 can be integrally formed as one piece. The two optical members 54 and 56 can be attached by multiple connection pieces 68. The connection pieces 68 can define one or more through-holes 70 between the first and second optical members 28 and 30. The plurality of strips 62 on each of the thermally conductive sheets 54 and 56 can then be bent around the bottom sides 64 of the optical members 28 and 30, and received through the through-holes 70. Some embodiments can also include a plurality of vent apertures 34 in the printed circuit board 18, as shown in FIG. 6, and each through-hole 70 between the first and second optical members 28 and 30 can be positioned over a corresponding vent aperture 34, such that air passing through an aperture 34 can also pass through the through-hole.

Referring again to FIG. 5, in some embodiments, the lighting apparatus 10 can further include a first plurality of light sources 72 located on the first side 24 of the printed circuit board 18, and a second plurality of light sources 74 located on the second side 26 of the printed circuit board. The first plurality of light sources 72 can be positioned to project light towards the first optical member 28. The second plurality of light sources 74 can be positioned to project light towards the second optical member 30. Having multiple light sources on each side of the printed circuit board 18 can help increase the light output to the desired space to be illuminated.

Figure 7:
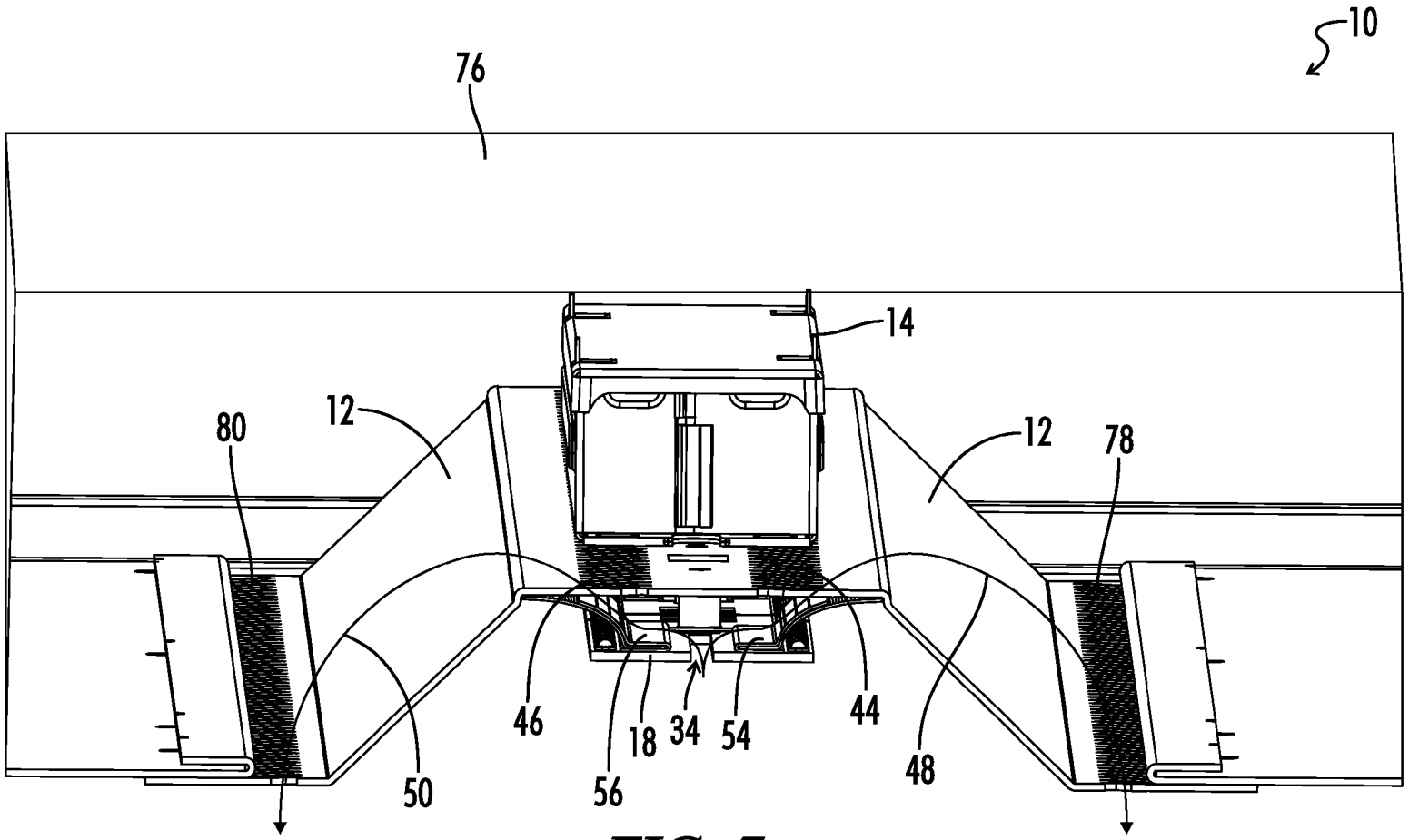
FIG. 7 is a cross section view of the lighting apparatus of FIG. 1 further including a light source driver enclosure.

A cross sectional view of an embodiment of a lighting apparatus 10 is shown in FIG. 7 having a light source driver enclosure 76. The enclosure 76 defines a space about the light source driver 14. The light source driver 14 can be placed on the housing 12 such that the light source driver 14 partially covers the first and second rows of housing vents 44 and 46 in the housing 12. As such, the light source driver 14 can be positioned adjacent the first and second convective paths 48 and 50 as the first and second convective paths 48 and 50 pass through the first and second rows of housing vents 44 and 46 respectively. As air passes through the vent aperture 34 in the printed circuit board 18, along the first and second convective paths 48 and 50, and through the first and second rows of housing vents 44 and 46, the air passes over the light source driver 14 which can additionally help cool the light source driver 14. The housing 12 can also include a first row of secondary housing vents 78 and second row of secondary housing vents 80. The first convective path 48 can extend out of the first row of housing vents 44 and through the first row of secondary housing vents 78 such that air along the first convective path 48 can be exhausted through the bottom of the lighting apparatus 10. Similarly, the second convective path 50 can extend out of the second row of housing vents 46 and through the second row of secondary housing vents 80 such that air along the second convective path 50 can be exhausted through the bottom of the lighting apparatus 10.

Thus, although there have been described particular embodiments of the present invention of a new and useful Flow Through Extended Surface Troffer System it is not intended that such references be construed as limitations upon the scope of this invention except as set forth in the following claims.

What is claimed is:

1. A light apparatus comprising:

a printed circuit board having first and second sides;

a first light source mounted on the first side of the printed circuit board;

a second light source mounted on the second side of the printed circuit board;

a first optical member positioned to receive and redirect light from the first light source;

a second optical member positioned to receive and redirect light from the second light source; and at least one vent aperture defined in the printed circuit board, the vent aperture located between the first and second optical members;

a housing at least partially surrounding the printed circuit board, the first and second light sources, and the first and second optical members;

the housing further comprises a first housing vent and a second housing vent, the first housing vent positioned adjacent the first optical surface, the second housing vent positioned adjacent the second optical surface;

the vent aperture in the printed circuit board and the first housing vent define a first convective path; and the vent aperture in the printed circuit board and the second housing vent define a second convective path.

2. The apparatus of claim 1, wherein:

the first optical member has a first back side facing away from the first light source;

the second optical member has a second back side facing away from the second light source; and the apparatus further comprises a first thermally conductive sheet disposed on the first back side of the first optical member, and a second thermally conductive sheet disposed on the second back side of the second optical member.

3. The apparatus of claim 2, wherein the first and second thermally conductive sheets comprise graphite.

4. The apparatus of claim 2, wherein the lighting apparatus emits light in a primary emission direction, and the printed circuit board is positioned to at least partially obstructs a direct view of the first and second thermally conductive sheets from the primary emission direction.

5. The apparatus of claim 2, wherein:

the first and second thermally conductive sheets are thermally coupled to the printed circuit board;

the first thermally conductive sheet extends from the printed circuit board across the first back side of the first optical member; and the second thermally conductive sheet extends from the printed circuit board across the second back side of the second optical member.

6. The apparatus of claim 1, wherein:

the housing further comprises at least one housing vent; and the vent aperture in the printed circuit board and the at least one housing vent define a convective path through the apparatus between the first and second optical surfaces.

7. The apparatus of claim 6, further comprising a light source driver positioned on the housing, the convective path passing adjacent the light source driver as the first convective path passes through the housing vent.

8. The apparatus of claim 1, wherein the at least one vent aperture is located centrally on the printed circuit board between the first and second optical members.

9. The apparatus of claim 1, further comprising:

a first plurality of light sources located on the first side of the printed circuit board and positioned to project light towards the first optical member; and a second plurality of light sources located on the second side of the printed circuit board and positioned to project light towards the second optical member.

10. The apparatus of claim 1, wherein the first and second optical members are integrally formed as one piece.

11. A lighting apparatus comprising:

a printed circuit board;

a first light source mounted to the printed circuit board;

a first optical member positioned to receive and redirect light projected from the light source, the first optical member having a first back side facing away from the light source; and a first thermally conductive sheet thermally coupled to the printed circuit board, the first thermally conductive sheet extending over the first back side of the first optical member;

a second light source mounted to the second side of the printed circuit board;

a second optical member positioned to receive and redirect light from the second light source, the second optical member having a second back side facing away from the second light source; and a second thermally conductive sheet thermally coupled to the printed circuit board, the second thermally conductive sheet extending over the second back side of the second optical member;

a vent aperture through the printed circuit board, the vent aperture positioned between the first and second optical members;

a housing at least partially surrounding the printed circuit board, the first and second light sources, and the first and second optical members;

a first housing vent located adjacent the first thermally conductive sheet; and a second housing vent located adjacent the second thermally conductive sheet.

12. The apparatus of claim 11, wherein the first thermally conductive sheet has a thermal conductivity greater than about 100 W/mk.

13. A lighting apparatus comprising:

a printed circuit board;

a first light source and a second light source mounted to the printed circuit board;

a first optical member positioned to receive and redirect light from the first light source, the first optical member having a first back side facing away from the first light source;

a second optical member positioned to receive and redirect light from the second light source, the second optical member having a second back side facing away from the second light source;

a first thermally conductive sheet thermally coupled to the printed circuit board and disposed on the first back side of the first optical member;

a second thermally conductive sheet thermally coupled to the printed circuit board and disposed on the second back side of the second optical member; and a vent aperture defined in the printed circuit board between the first and second thermally conductive sheets;

a housing partially surrounding the printed circuit board, the first and second light sources, the first and second optical members, and the first and second thermally conductive sheets, the housing comprising a first housing vent positioned adjacent the first thermally conductive sheet and a second housing vent positioned adjacent the second thermally conductive sheet;

the vent aperture in the printed circuit board and the first housing vent define a first convective path over the first thermally conductive sheet; and the vent aperture in the printed circuit board and the second housing vent define a second convective path over the second thermally conductive sheet.

* * * * *